US005109949A

United States Patent [19]

Sato et al.

[11] Patent Number: 5,109,949

[45] Date of Patent: May 5, 1992

[54] MUFFLER OF INDUSTRIAL ENGINE

[75] Inventors: Toru Sato; Yoshio Kobayashi; Tomiya Kato, all of Nagoya, Japan

[73] Assignee: Mitsubishi Jukogyo Kabushiki Kaisha, Tokyo, Japan

[21] Appl. No.: 574,289

[22] Filed: Aug. 28, 1990

[30] Foreign Application Priority Data

Aug. 30, 1989 [JP] Japan ..... 1-100431[U]
Mar. 16, 1990 [JP] Japan ..... 2-26190[U]

[51] Int. Cl.[5] ..... F01N 7/10; F01N 1/08
[52] U.S. Cl. ..... 181/240; 181/265
[58] Field of Search ..... 181/240, 229, 265, 266, 181/264, 269, 268

[56] References Cited

U.S. PATENT DOCUMENTS 4,418,790 12/1983 Agnew ..... 181/268 X

FOREIGN PATENT DOCUMENTS 0135455 12/1986 European Pat. Off. .
3829668 6/1989 Fed. Rep. of Germany .
2-50120 4/1990 Japan .
280315 12/1927 United Kingdom .

OTHER PUBLICATIONS

Patent Abstracts of Japan, vol. 8, No. 148 (M-308), Jul. 1984.

*Primary Examiner*—Russell E. Adams
*Assistant Examiner*—Jae Noh
*Attorney, Agent, or Firm*—Wenderoth, Lind & Ponack

[57] ABSTRACT

The known muffler of an industrial engine, in which a channel communicating with an exhaust gas outlet is integrally formed on the inside of a muffler main body made of an aluminum diecast, and an inner lid is mounted to the open side of the channel to form an exhaust gas passageway serving also as a tail pipe, within the muffler main body as disclosed in Japanese Utility Model Application No. 63-127369 (1988) is improved. The improvements reside in that a cross-section area of the channel is reduced gradually or in a stepwise manner from its inlet towards the exhaust gas outlet so as to prevent carbon from adhering to the exhaust passageway, and in that at the exhaust gas outlet is formed a projecting wall adapted to butt against the inner lid, integrally with the muffler main body so as to prevent the exhaust gas escape without passing through the exhaust gas passageway.

6 Claims, 3 Drawing Sheets

MUFFLER OF INDUSTRIAL ENGINE

BACKGROUND OF THE INVENTION

1. Field of the Invention

The present invention relates to a muffler of an industrial engine, and more particularly to improvements in a structure of such type of muffler.

2. Description of the Prior Art

As the above-mentioned type of muffler, the inventor of this invention proposed previously in Japanese Utility Model Application No. 63-127369 (1988), a structure of a muffler of an industrial engine, in which a channel communicating with an exhaust gas outlet is formed integrally on the inside of a muffler main body consisting of a diecast article, an inner lid consisting of a diecast or a sheet metal is joined to the open side of the aforementioned channel, and thereby an exhaust gas passageway serving also as a tail pipe is constructed within the muffler main body.

FIGS. 5 to 7 illustrate the muffler disclosed in the above-referred Japanese Utility Model Application No. 63-127369 (1988), in which on the inside of a muffler main body 100 consisting of an aluminum diecast article having an exhaust gas inlet 100*a* and an exhaust gas outlet 100*b*, is formed a U-shaped channel 103 communicating with the exhaust gas outlet 100*b* by means of a wall 100*c* constructed integrally with the main body 100, and by joining and fastening, by means of a clamp screw 102, an inner lid 101 consisting of a diecast or a sheet metal on the opening side of the above-mentioned channel 103, an exhaust gas passageway 130 serving also as a tail pipe is constructed within the muffler main body 100, thus as compared to the structure in which a tail pipe is fixed to the exhaust gas outlet 100*b* of the muffler main body 100, shaping of the tail pipe is facilitated, and also by modifying the shape of the exhaust gas passageway, a path length from the inlet to the outlet can be arbitrarily changed, and tuning with respect to performance (output, noise) is made possible.

However, the above-mentioned structure of a muffler in the prior art involved the following problems. That is, the inlet of the tail pipe is liable to be clogged by carbon because the exhaust gas passageway is abruptly choked and a flow velocity of the exhaust gas changes suddenly there, hence the tail pipe must be cleaned frequently, and also a curved portion of the exhaust gas passageway in the tail pipe is also apt to be clogged by carbon, so that the time necessitating maintenance becomes frequent. In addition, in the above-described muffler in the prior art, since the exhaust gas passageway 130 is formed by joining an inner lid 101 consisting of a diecast or a sheet metal to the open side of the channel 103 formed of a diecast, upon fastening this inner lid 101 by means of a clamp screw 102 there is a possibility that the inner lid 101 may be deviated in position by an amount corresponding to a looseness of a through-hole for the clamp screw, and as a result, there was a fear that the exhaust gas may escape directly through a gap formed by the deviation to the exhaust gas outlet 100*b* without passing through the exhaust gas passageway 130, and so, the muffler cannot achieve the function of a tail pipe.

SUMMARY OF THE INVENTION

It is therefore one object of the present invention to provide an improved muffler of an industrial engine, in which adhesion of carbon is little and maintenance is easy.

Another object of the present invention is to provide a muffler of an industrial engine, in which formation of a gap clearance between an open side edge of a channel and an inner lid mounted to the open side of the channel can be prevented.

According to one feature of the present invention, in a muffler of an industrial engine of the type that a channel communicating with an exhaust gas outlet is integrally formed on the inside of a muffler main body made of an aluminum diecast, and an inner lid is mounted to the open side of the channel to form an exhaust gas passageway serving also as a tail pipe, within the muffler main body, a cross-section area of the channel is reduced gradually or in a stepwise manner from its inlet towards the exhaust gas outlet.

Owing to the above-featured construction, according to the present invention, since an inlet cross-section area of a tail pipe can be designed to be large, variation of a flow velocity of exhaust gas becomes relatively small, and also, since the flow velocity can be increased gradually or in a stepwise manner by reducing the cross-section area of the tail pipe gradually or in a stepwise manner, carbon would hardly adhere to the exhaust gas passageway serving also as a tail pipe.

The cross-section area of the above-mentioned channel can be easily reduced gradually or in a stepwise manner from its inlet towards the exhaust gas outlet by reducing a channel width or a channel depth of the channel gradually or in a stepwise manner.

According to another feature of the present invention, in a muffler of an industrial engine of the type that a channel communicating with an exhaust gas outlet is integrally formed on the inside of a muffler main body made of an aluminum diecast, and an inner lid is mounted to the open side of the channel to form an exhaust gas passageway serving also as a tail pipe, within the muffler main body, at the exhaust gas outlet is formed a projecting wall adapted to butt against the inner lid, integrally with the muffler main body.

Owing to the above-featured construction, according to the present invention, since the inner lid joined to the open side of the channel would butt against the projecting wall on the inside of the exhaust gas outlet and would close the exhaust gas outlet, even if the inner lid to be joined to the open side of the channel should be deviated in position by an amount corresponding to a looseness of a through-hole for a clamp screw, or even if the inner lid should be short due to poor machining precision of parts, a gap clearance would not be formed between the channel and the inner lid, and so it would never occur that exhaust gas escapes directly to the exhaust gas outlet without passing through the exhaust gas passageway. Therefore, the machining precision in size and configuration of parts could be low, hence manufacture of the parts is easily, and the muffler can be easily assembled.

The above-mentioned and other objects, features and advantages of the present invention will become more apparent by reference to the following description of preferred embodiments of the invention taken in conjunction with the accompanying drawings.

DESCRIPTION OF THE PREFERRED EMBODIMENTS

Figure 1:
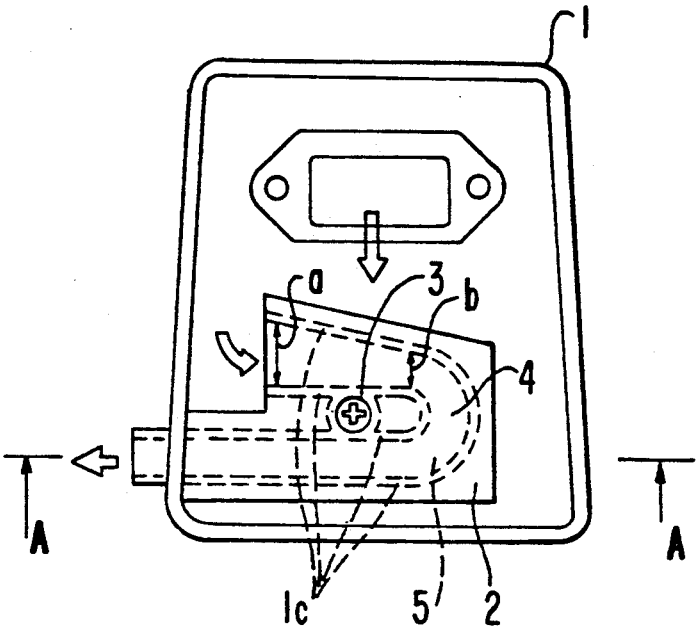
FIG. 1 is a front view of a muffler according to a first preferred embodiment of the present invention.
Figure 2:
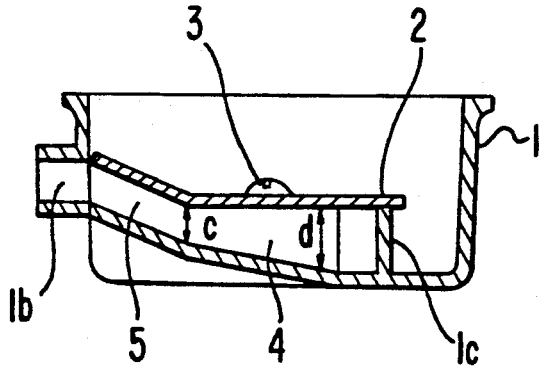
FIG. 2 is a cross-section view taken along line A—A in FIG. 1 as viewed in the direction of arrows.

Now a first preferred embodiment of the present invention will be described with reference to FIGS. 1 and 2, FIG. 1 is a front view showing the inside of a muffler, and FIG. 2 is a cross-section view of an exhaust gas passageway. As seen from these figures, on the inside of a muffler main body 1 consisting of an aluminum diecast article is formed a U-shaped channel 4 communicating with an exhaust gas outlet 1*b* by means of a wall 1*c* constructed integrally with the muffler main body 1. By joining and mounting an inner lid 2 made of a diecast or a sheet metal to the open side of the channel 4 and fastening them by means of a screw 3, and exhaust gas passageway 5 serving also as a tail pipe is formed within the muffler main body 1.

At this time, the cross-section area of the exhaust gas passageway 5 is gradually reduced by appropriately positioning walls 1*c*, that is, by gradually reducing the channel width from an inlet width a to a width b, or by gradually reducing the channel depth from an appropriately set depth d to a shallower depth c or by combining these. The change of the cross-section area could be stepwise.

As described above, according to this preferred embodiment, owing to the fact that the channel 4 communicating the exhaust gas outlet 1*b* is integrally formed on the inside of the muffler main body 1 made of an aluminum diecast, the inner lid 2 consisting of a diecast or a sheet metal is mounted to the open side of the above-mentioned channel 4 to form the exhaust gas passageway 5 serving also as a tail pipe within the muffler main body, and the cross-section area of the aforementioned channel 4 is reduced gradually or in a stepwise manner from its inlet towards the aforementioned exhaust gas outlet, the inlet cross-section area of the tail pipe can be made large, hence a variation of a flow velocity of the exhaust gas is relatively small, and clogging of the tail pipe by carbon would hardly occur. In addition, at a curved portion or a portion where a direction changes abruptly of the tail pipe or in the neighborhood of the portion, since it is possible to increase a flow velocity by gradually reducing the cross-section area of the tail pipe, carbon would be blown away and the tail pipe would be hardly clogged. Consequently, maintenance becomes easy.

Figure 3:
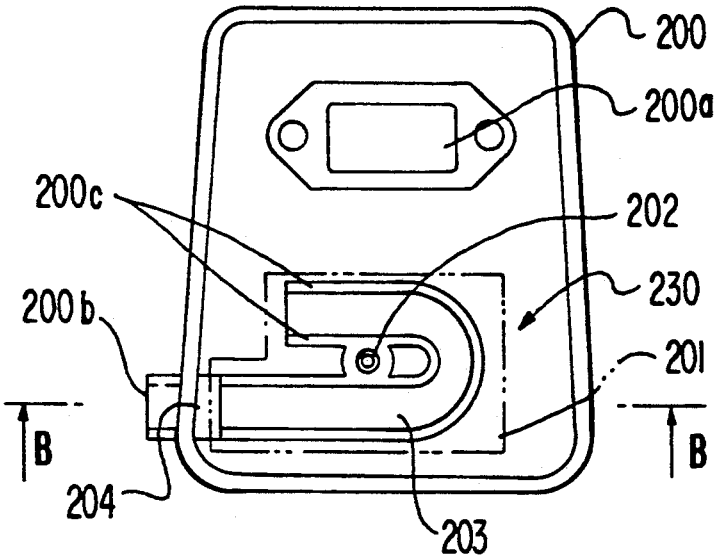
FIG. 3 is a front view showing a second preferred embodiment of the present invention.
Figure 4:
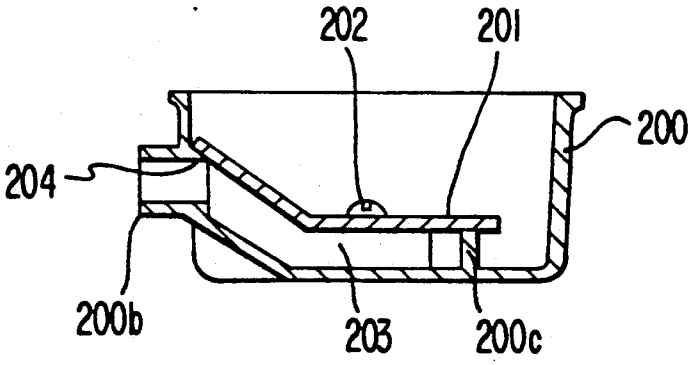
FIG. 4 is a cross-section view taken along line B—B in FIG. 3 as viewed in the direction of arrows.
Figure 5:
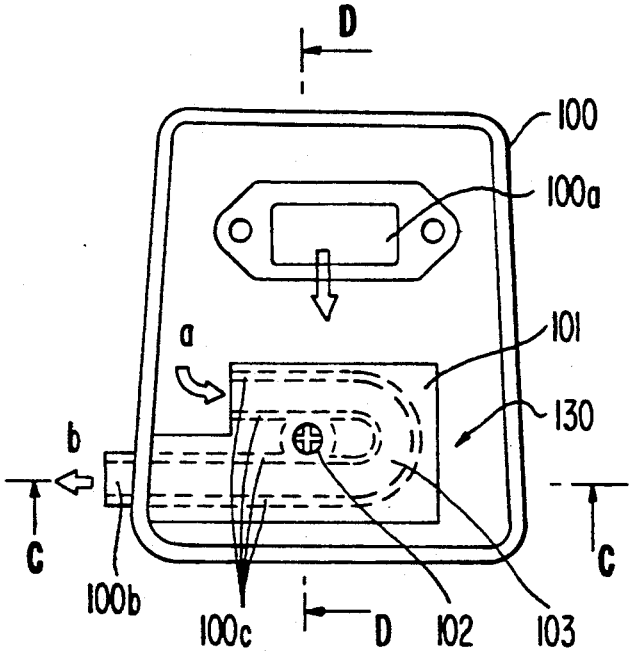
FIG. 5 (PRIOR ART)
FIG. 5 is a front view showing a muffler of an industrial engine in the prior art.
Figure 7:
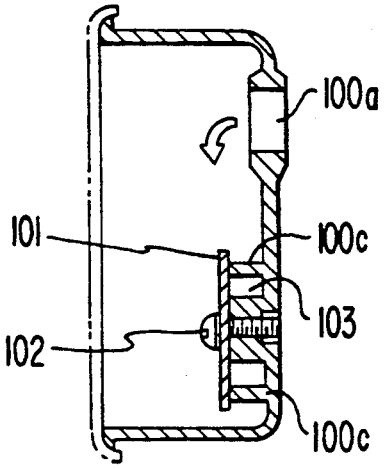
FIG. 7 (PRIOR ART)
FIG. 7 is a cross-section view taken along line D—D in FIG. 5 as viewed in the direction of arrows.
Figure 6:
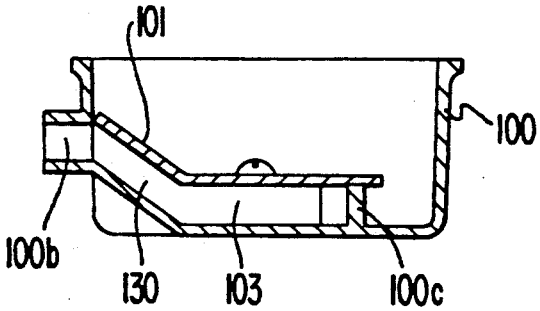
FIG. 6 (PRIOR ART)
FIG. 6 is a cross-section view taken along line C—C in FIG. 5 as viewed in the direction of arrows.

Next, description will be made on a second preferred embodiment of the present invention illustrated in FIGS. 3 and 4. Referring to these figures, in a muffler main body 200 made of an aluminum diecast are formed an exhaust gas inlet 200*a*, an exhaust gas outlet 200*b* and a U-shaped channel 203 communicating with the exhaust gas outlet 200*b* integrally with the main body 200, to the open side of the channel 203 is secured and fastened an inner lid 201 consisting of a diecast or a sheet metal by means of a clamp screw 203 as butting against walls 200*c* forming the channel 203, and thus an exhaust gas passageway 230 communicating with the exhaust gas outlet 200*b* is formed within the muffler main body 200 by means of the channel 203 and the inner lid 201. On the inside of the muffler outlet 200*b* is provided a projecting wall 204 adapted to butt against the inner lid 201 as projected from the inside of the outlet 200*b*.

As described above, since the projecting wall 204 adapted to butt against the inner lid 201 is formed at the exhaust gas outlet 200*b* of the exhaust gas passageway 230 formed of the channel 203 within the muffler main body 200 and the inner lid 201 joined to the open side of the channel 203, at the exhaust gas outlet 200*b* of the exhaust gas passageway 230, the projecting wall 204 projected from the main body and the inner lid 201 are superposed with each other, and so, even if machining precision of the size and configuration of the inner lid 201 should be low, a gap clearance would not be formed therebetween. Accordingly, it would never occur that exhaust gas may directly escape through the exhaust gas outlet 200*b* without passing through the exhaust gas passageway 230, and also upon fastening the inner lid 201 there is no need to push the inner lid 201 towards the exhaust gas outlet 200*b*, so that there is an advantage that assembly becomes easy.

While a principle of the present invention has been described above in connection to preferred embodiments of the invention, it is intended that all matter contained in the above description and illustrated in the accompanying drawings shall be interpreted to be illustrative and not in a limiting sense.

What is claimed is:

1. A muffler of an industrial engine comprising:

a muffler main body made of an aluminum casting, said main body having outer walls defining an inner chamber of the main body, a gas outlet extending through said outer walls and open to the exterior of the main body, and exhaust channel walls extending in said chamber and integral with said outer walls, said exhaust channel walls defining a channel open to said gas outlet; and a lid mounted to said main body over said channel so as to form an exhaust gas passageway with said channel walls, the exhaust gas passageway having an inlet end located in said chamber and extending to said gas outlet so as to serve as a tail pipe, and said exhaust gas passageway having a cross-sectional area that only decreases gradually or in a stepwise manner from said inlet end thereof to said gas outlet.

2. A muffler of an industrial engine as claimed in claim 1, wherein said channel walls are curved, and said channel extends along a U-shaped path from said inlet end thereof to said gas outlet.

3. A muffler of an industrial engine as claimed in claim 1, wherein said channel walls converge in a manner in which the width of said channel decreases gradually or in a stepwise manner as taken in a direction therealong from said inlet end towards said gas outlet.

4. A muffler of an industrial engine as claimed in claim 1, wherein said lid and a portion of the outer walls of said muffler main body disposed across said exhaust gas passageway from said lid converge in a manner in which the depth of said exhaust gas passageway decreases gradually or in a stepwise manner as taken in a direction therealong from said inlet end thereof towards said gas outlet.

5. A muffler of an industrial engine comprising:

a muffler main body made of an aluminum casting, said main body having outer walls defining an inner chamber of the main body, a gas outlet extending through said outer walls and open to the exterior of the main body, and exhaust channel walls extending in said chamber and integral with said outer walls, said exhaust channel walls defining a channel open to said gas outlet; a lid mounted to said main body over said channel so as to form an exhaust gas passageway with said channel walls, the exhaust gas passageway having an inlet end located in said chamber and extending to said gas outlet so as to serve as a tail pipe; and a projecting wall integral with the outer walls of said main muffler body and extending therefrom at an upper portion of said exhaust gas outlet so as to be located at a side of the channel opposite the bottom thereof, said lid abutting said projecting wall in a superposed manner.

6. A muffler of an industrial engine as claimed in claim 5, wherein said projecting wall extends into said chamber of the main body.

* * * * *